US009021641B2

(12) United States Patent
Leach et al.

(10) Patent No.: US 9,021,641 B2
(45) Date of Patent: May 5, 2015

(54) WELDER MULTI-TOOL

(71) Applicant: Lincoln Global, Inc., City of Industry, CA (US)

(72) Inventors: Jason Karl Leach, Cleveland Heights, OH (US); Jamy Edward Bulan, Lakewood, OH (US)

(73) Assignee: Lincoln Global, Inc., City of Industry, CA (US)

( * ) Notice: Subject to any disclaimer, the term of this patent is extended or adjusted under 35 U.S.C. 154(b) by 62 days.

(21) Appl. No.: 13/804,123

(22) Filed: Mar. 14, 2013

(65) Prior Publication Data

US 2014/0259437 A1 Sep. 18, 2014

(51) Int. Cl.
*B26B 11/00* (2006.01)
*B25F 1/04* (2006.01)

(52) U.S. Cl.
CPC ..... *B25F 1/04* (2013.01)

(58) Field of Classification Search
USPC ..... 7/118, 119, 164, 158, 163
See application file for complete search history.

(56) References Cited

U.S. PATENT DOCUMENTS

| | | | | |
|---|---|---|---|---|
| 1,523,808 | A | 1/1925 | Kropacz | |
| 1,840,135 | A * | 1/1932 | Schutt | 7/164 |
| 3,315,295 | A | 4/1967 | Jeter et al. | |
| 3,858,325 | A * | 1/1975 | Goerler | 33/199 R |
| 4,595,136 | A | 6/1986 | Cooper | |
| 4,667,412 | A * | 5/1987 | Carlson | 33/760 |
| 5,146,815 | A * | 9/1992 | Scott, III | 81/437 |
| 5,212,844 | A | 5/1993 | Sessions et al. | |
| 5,611,149 | A * | 3/1997 | Fujiwara | 33/833 |
| 6,564,678 | B1 * | 5/2003 | Wang | 81/124.4 |
| 7,080,423 | B2 | 7/2006 | Seber et al. | |
| 7,793,570 | B2 | 9/2010 | Mattson et al. | |
| 2004/0141313 | A1 * | 7/2004 | Elsener | 362/119 |
| 2011/0162149 | A1 * | 7/2011 | Merten et al. | 7/119 |

FOREIGN PATENT DOCUMENTS

| | | | |
|---|---|---|---|
| WO | 01/30542 | A1 | 5/2001 |
| WO | 2007/125447 | A1 | 11/2007 |

OTHER PUBLICATIONS

"7 Piece Fillet Weld Set", online document available at http://www.newmantools.com/gauge/7piece.htm, Newman Tools, Inc., 2013.
"US Forge Welding Tip Cleaner #00802", online document available at http://www.amazon.com/US-Forge-Welding-Cleaner-00802/dp/B000UVR0NO, US Forge, 2013.

* cited by examiner

*Primary Examiner* — Monica Carter
*Assistant Examiner* — Melanie Alexander
(74) *Attorney, Agent, or Firm* — Pearne & Gordon LLP

(57) ABSTRACT

A welder multi-tool is provided including a sleeve having a first leg portion, a second leg portion, and a bridge portion interconnecting the first leg portion and the second leg portion. The sleeve extends along a central axis passing through the bridge portion and defines a space between the leg portions. A single axle is attached to the sleeve and spans, along an axis, the space defined between the leg portions. The axis of the axle does not intersect the central axis of the sleeve. The welder multi-tool further includes a plurality of tools rotatably attached to the axle. Each tool axis does not intersect the axis of the axle. The plurality of tools includes a fillet gauge tool and a thickness gauge tool. A further example of the welder multi-tool includes a fillet gauge tool, a thickness gauge tool, a soap stone, and a welding nozzle cleaner.

16 Claims, 3 Drawing Sheets

WELDER MULTI-TOOL

BACKGROUND

The present disclosure relates generally to multi-tools, and more particularly, to an apparatus for combining multiple welding tools.

People associated with creating and inspecting welds utilize a number of tools, some of which are specialized for welding purposes. These tools can often be stored and transported individually without protection for the tools or the user of the tools. When a collection of tools are stored and transported individually as described, they can often be misplaced. The tools can also be damaged by impact with other tools, impact with a hard surface after a fall, etc. The user carrying this relatively large number of tools can be poked, jabbed, and otherwise negatively affected by the tools as the user tries to grasp the tools within a pocket or a toolbox. Current methods for storing and transporting welding tools often include a random array of tools kept within a tool box or in a pocket. As such, consistently locating and protecting the individual tools can be difficult, and the user can be negatively affected by the lack of safety considerations involving loose tools. Furthermore, many of these tools lack substantial handles and/or grips enabling a user to have adequate leverage to apply suitable force or torques to the tools. Accordingly, it would be beneficial to provide a welder multi-tool for safely containing a number of disparate welding-related tools that solves one or more of these problems.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, a welder multi-tool is provided. The welder multi-tool includes a sleeve including a first leg portion and a second leg portion, and a bridge portion interconnecting the first leg portion and the second leg portion at respective first ends of the leg portions. The sleeve extends along a central axis passing through the bridge portion. The sleeve at least partially defines a space between the leg portions. The welder multi-tool also includes a single axle attached to the sleeve. The axle spans, along an axis, the space defined between the leg portions. The axis of the axle does not intersect the central axis of the sleeve. The welder multi-tool further includes a plurality of tools rotatably attached to the axle. The tools are movable to a home position between the leg portions. Each of the plurality of tools has a tool axis, and each tool axis is substantially parallel with the central axis of the sleeve when the plurality of tools is in the home position between the leg portions. Each tool axis does not intersect the axis of the axle. The plurality of tools includes a fillet gauge tool. The fillet gauge tool includes a central column including at least one set of graduated measurements. The fillet gauge tool further includes a measuring portion. The measuring portion is slidingly engaged with the central column. The measuring portion defines a slot. The fillet gauge tool still further includes a wing portion that is rotatably attached to the central column. The wing portion includes two angled surfaces such that the two angled surfaces form an angle having a vertex that intersects with the tool axis of the fillet gauge tool. The fillet gauge tool also includes a locking portion attached to the central column. The locking portion extends through the slot in the measuring portion. The plurality of tools further includes a thickness gauge tool. The thickness gauge tool includes a main portion defining a plurality of notches located on an edge of the main portion. Each of the notches includes a label indicating the nominal width of the notch as measured along the edge of the main portion.

In accordance with another aspect, a welder multi-tool is provided. The welder multi-tool includes a sleeve which includes a first leg portion and a second leg portion and a bridge portion interconnecting the first leg portion and the second leg portion at respective first ends of the leg portions. The sleeve extends along a central axis passing through the bridge portion. The sleeve at least partially defines a space between the leg portions. The welder multi-tool also includes a single axle attached to the sleeve. The axle spans, along an axis, the space defined between the leg portions. The axis of the axle does not intersect the central axis of the sleeve. The welder multi-tool further includes a plurality of tools rotatably attached to the axle and movable to a home position between the leg portions. Each of the plurality of tools has a tool axis, and each tool axis is substantially parallel with the central axis of the sleeve when the plurality of tools is in the home position between the leg portions. Each tool axis does not intersect the axis of the axle. The plurality of tools includes a fillet gauge tool, a thickness gauge tool, a soap stone, and a welding nozzle cleaner.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

DETAILED DESCRIPTION

Figure 1:
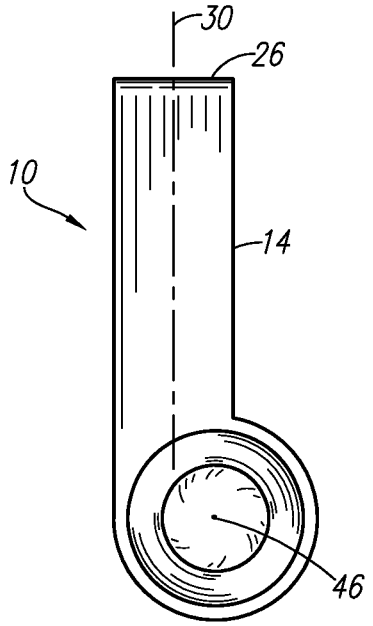
FIG. 1 is a front view of an example welder multi-tool showing an offset between a central axis of the sleeve and an axis of the axle.

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation. Still further, in the drawings, the same reference numerals are employed for designating the same elements.

FIG. 1 illustrates a front view of an example welder multi-tool 10. In short summary, the welder multi-tool 10 is a collection of tools that are helpful for persons involved in welding. These persons can include welders, welding inspectors, engineers, those who purchase weldments, etc. The welder multi-tool 10 includes a plurality of tools which are mounted to an axle around which the plurality of tools can be selectively rotated through 360°. The welder multi-tool also includes a sleeve which can protect the plurality of tools and a user when the tools are located in a home position.

Figure 2:
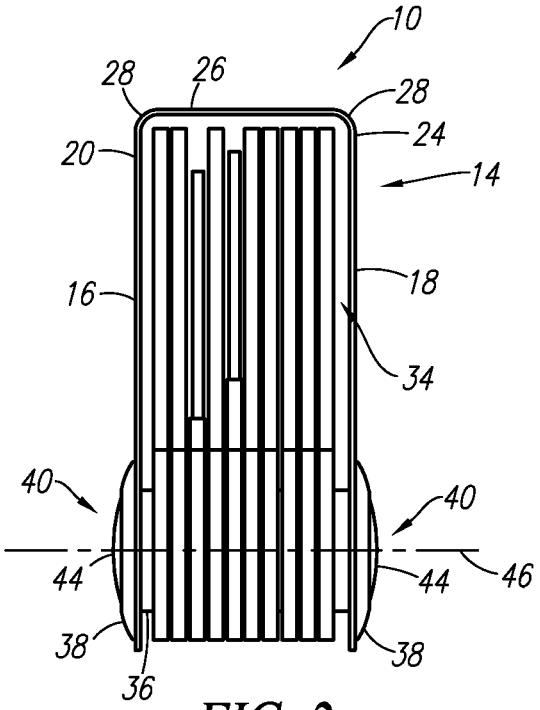
FIG. 2 is a side view of the example welder multi-tool shown in FIG. 1 showing a number of tools in their home position.

Turning to FIG. 2, the welder multi-tool 10 includes a sleeve 14. The sleeve includes a first leg portion 16 and a second leg portion 18 with the first leg portion 16 having a first end 20 and the second leg portion 18 having a first end 24. The sleeve 14 is bent to form a bridge portion 26 interconnecting the first leg portion 16 and the second leg portion 18 at respective first ends 20, 24 of the leg portions 16, 18. In the shown orientation, the leg portions 16, 18 are generally vertical and the bridge portion 26 is substantially perpendicular to the leg portions 16, 18 to form a "U" shape. The bent portions 28 of the sleeve 14 can each include a bending radius to create smooth curves for the bent portions 28. Smooth curves can improve the tactile feel of the sleeve 14 and reduce the chance of marking, slicing, or snagging materials with which the sleeve 14 comes into contact. In another example, the bent portions 28 can be formed at an angle, such as a right angle. Any suitable material can be used to form the sleeve 14. In one example, the sleeve 14 can comprise a metal alloy such as aluminum that is stamped and/or otherwise formed into the U-shape as shown in FIG. 2.

The sleeve 14 at least partially defines a space 34 between the leg portions 16, 18. The space 34 created by the sleeve 14 is bounded on at least three sides, represented by the first leg portion 16, the second leg portion 18, and the bridge portion 26. The size of the space 34 can be predetermined to provide adequate room for various tools as will be described below. As is best seen in FIG. 1, the sleeve 14 extends along a central axis 30 passing through the bridge portion 26.

Returning to FIG. 2, the welder multi-tool 10 also includes a single axle 36 attached to the sleeve 14. The axle 36 spans the space 34 defined between the leg portions 16, 18. Any suitable connection between the axle 36 and the sleeve 14 can be used. In one example, the axle 36 is rigidly attached to the sleeve 14 such that there is no relative motion between the sleeve 14 and the axle 36. In another example, the axle 36 can be rotatably attached to the sleeve 14. In a further example, and end of the axle 36 can extend through the sleeve 14 and create a portion 38 of a rounded button 40 on the exterior side of the leg portions 16, 18. A cap 44 can also be located on the end of the axle 36 to help create a smooth, rounded surface that can be used for handling the welder multi-tool as will be described below. In yet another example, the rounded button 40 can be a one-piece construct that is otherwise attached to the sleeve 14 or the axle 36.

As is best seen in FIG. 2, the axle 36 is attached to the sleeve 14 and spans the space 34 defined between the leg portions 16, 18 along an axis 46. The axis 46 of the axle does not intersect the central axis 30 of the sleeve 14 which can be seen in FIG. 1 where a dot represents the axis 46 which extends along a line going into and out of the paper space of FIG. 1. The described lack of intersection between the central axis 30 and the axis 46 creates an offset between the sleeve 14 and the axle 36.

Figure 3:
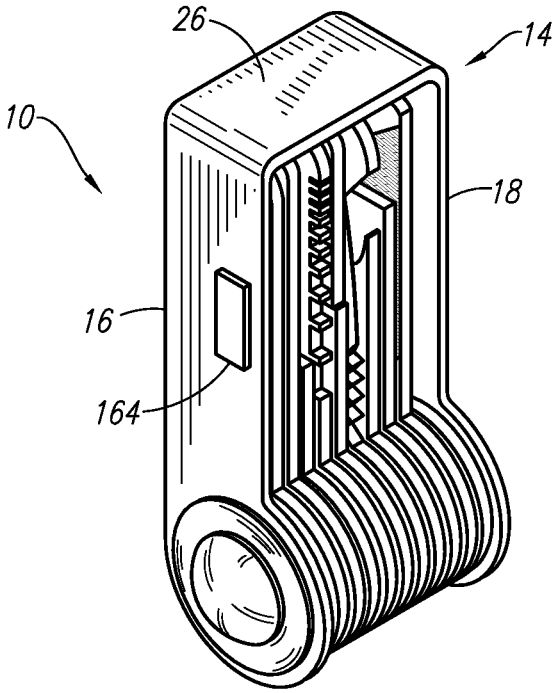
FIG. 3 is a perspective view of the example welder multi-tool shown in FIG. 1.

As can be seen in the side view of FIG. 2 or the perspective view of FIG. 3, the welder multi-tool 10 further includes a plurality of tools rotatably attached to the axle 36. In one example, each tool can selectively be rotated 360° about the axle 36. Each of the tools is movable to a home position located in the space 34 between the leg portions 16, 18 such that the sleeve 14 substantially covers the plurality of tools as shown in FIGS. 2 and 3. In the home position, the tools as a group are essentially covered on three sides by the leg portions 16, 18 and the bridge portion 26. In this manner, the sleeve 14 can provide protection for each tool so that rough handling, dropping, crushing, etc. will have a minimized effect on the tools. Additionally, the sleeve 14 can provide protection for a user of the welder multi-tool 10 such that tools in the home position are covered when not in use and relatively less likely to poke, gouge, scratch, or otherwise negatively affect the user.

Figure 7:
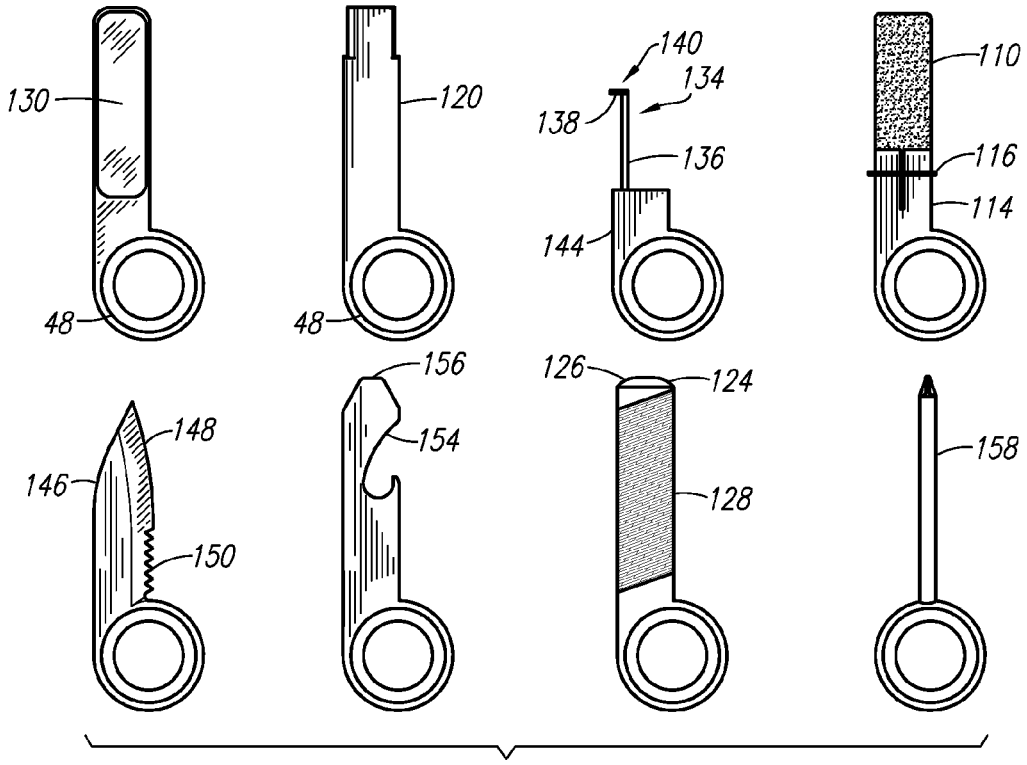
FIG. 7 is a front view of eight additional tools which can be included in the welder multi-tool of FIG. 1.

Any suitable attachment method can be used to secure the tools to the axle 36. In one example, each of the tools can include mounting structure such as a bearing 48 as is best seen in FIG. 7. The mounting structure can promote smooth rotation of the tool about the axle 36. The mounting structure can also be configured to require a minimum force to selectively rotate each tool around the axle 36. The mounting structure can also include any number of features such as movable latches and detents so that each tool can be selectively placed in the home position and require a force greater than the previously described minimum force to move the tool from its home position. In this example, after leaving the home position, the tool will require the lesser minimum force in order to be rotated around the axle 36.

Figure 4:
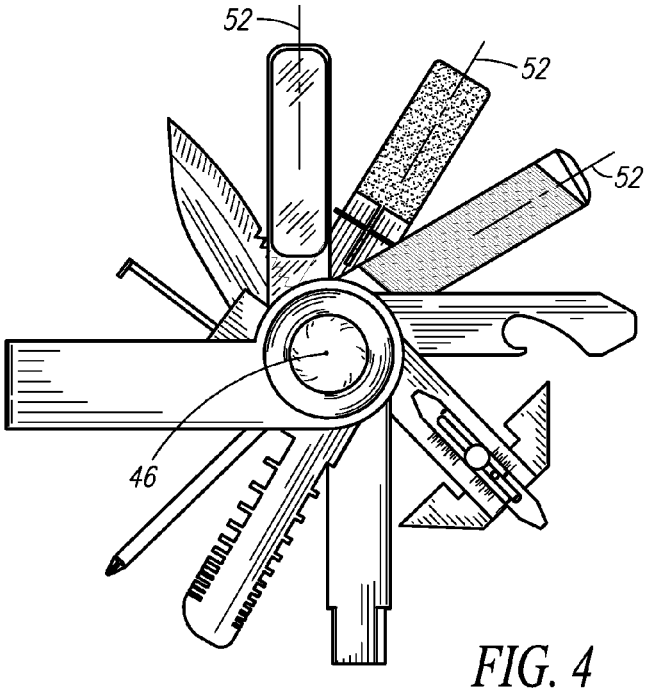
FIG. 4 is a front view of the example welder multi-tool shown in FIG. 1, showing tools individually rotated around the axle.

Turning to FIG. 4, a group of ten tools is shown where each tool is rotated to its own position about the axle 36. This view illustrates that each tool can be selectively rotated about the axle 36 and each of the tools can be individually rotated about the axle 36. Additionally, each of the plurality of tools has a tool axis 52 which is shown for a limited number of the tools, but it is to be understood that each of the tools includes a tool axis 52. Returning to FIG. 1, when the tools are placed in the home position, each tool axis 52 is substantially parallel with the central axis 30 of the sleeve 14. Additionally, all, or at least a majority of the tool axes 52 are coplanar with the central axis 30 of the sleeve 14 when the tools are placed in the home position. As such, in FIG. 1, the line representing the central axis 30 also represents the tool axes 52 when the tools are in the home position. With the configuration of the tool axes 52 being coplanar with the central axis 30, each tool axis 52 does not intersect the axis 46 of the axle 36. As a result, similar to the orientation of the sleeve 14 with respect to the axle 36 as described above, the tools are also offset with respect to the axle 36. Alignment of the tool axes 52 and the central axis 30 of the sleeve 14 enables the sleeve 14 and the plurality of tools to have substantially the same shape when viewed from a common angle. This feature can be best seen in the front view of FIG. 1 where the sleeve 14 substantially has the same shape as the tools and substantially covers the tools when viewed from a common angle, such as the front view.

Figure 5:
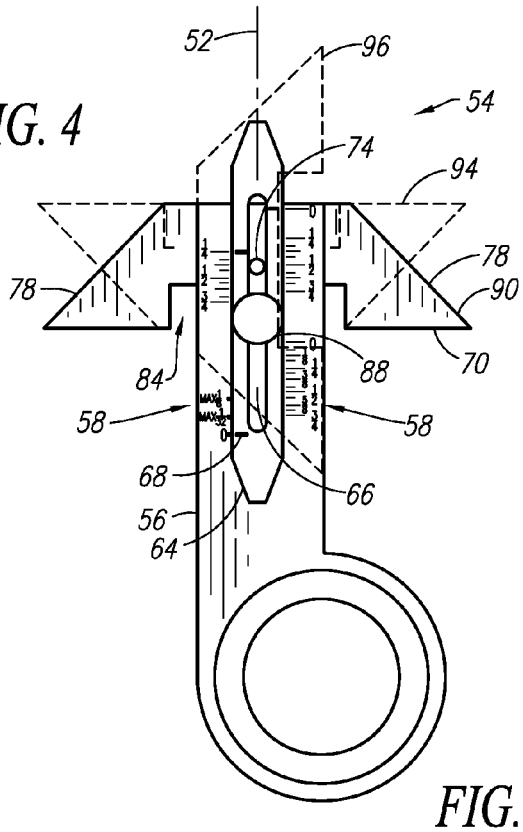
FIG. 5 is a front view of an example fillet gauge tool which can be included in the welder multi-tool of FIG. 1.

Turning to FIG. 5, the plurality of tools includes a fillet gauge tool 54. The fillet gauge tool 54 includes a central column 56. The central column 56 includes at least one set of graduated measurements 58. In the shown example, the central column 56 includes four sets of graduated measurements 58, two sets on either side of the central column 56. The graduated measurements 58 enable the user to measure various aspects of welds, in particular fillet welds as will be described below.

The fillet gauge tool 54 also includes a measuring portion 64. The measuring portion 64 is slidingly engaged with the central column 56, and any suitable method of creating the sliding engagement between the measuring portion 64 and the central column 56 can be utilized. In the shown example, the measuring portion 64 has a length dimension that is significantly longer than its width dimension, and each end of the measuring portion 64 is tapered to help facilitate measurement of various aspects of welds. The measuring portion 64 also defines a slot 66. A plurality of indicating marks 68 can be included on the measuring portion 64, each indicating mark 68 corresponding with a set of graduated measurements 58 located on the measuring portion 64.

The fillet gauge tool 54 further includes a wing portion 70 which is rotatably attached to the central column 56. One example form of attachment of the wing portion 70 to the central column 56 is shown in FIG. 5. One or the other of the wing portion 70 and the central column 56 can include a pin 74. The wing portion 70 is configured to rotate about the pin 74. The shown example wing portion 70 includes two angled surfaces 78 such that the two angled surfaces 78 form an angle having a vertex that intersects with the tool axis 52 of the fillet gauge tool 54. In one example, the angle formed by the two angled surfaces 78 is a right angle. The wing portion 70 can also define a notch 84.

The fillet gauge tool 54 further includes a locking portion 88 attached to the central column 56. The locking portion 88 extends through the slot 66 in the measuring portion 64. In one example, the locking portion 88 can be generally cylindrical with a stepped outside diameter. With this configuration, a smaller outside diameter can pass through the slot 66 while a larger diameter at the end of the locking portion 88 that is not attached to the central column 56. This larger diameter can help maintain the sliding engagement of the measuring portion 64 with the central column 56. Working together with the pin 74, the locking portion 88 can also limit the sliding engagement of the measuring portion 64 with the central column 56 to a linear motion. Additionally, the shown configuration of the pin 74 and the locking portion 88 can also help maintain a parallel arrangement between the measuring portion 64 and the central column 56.

In a further example, the locking portion 88 can be threadingly engaged with the central column 56 such that rotation of the locking portion 88 can effectively clamp the measuring portion 64 between the locking portion 88 larger diameter section and the central column 56. In this way, the measuring portion 64 can be held in place to maintain a particular position showing a particular measurement. Alternatively, the welder multi-tool 10 having the measuring portion 64 locked in a desired location can also become a form of a "go-no go" gauge. In one example of a go-no go gauge, the measuring portion 64 is clamped in a particular position and the welder multi-tool 10 can be slid along a particular weld to see if the weld geometry defines predetermined desired dimensions. Rotation of the locking portion 88 in the opposite direction can then release the measuring portion 64 for further measurements.

The rotatable attachment between the wing portion 70 and the central column 56 enables the wing portion 70 to be placed in several orientations to facilitate several functions. With the wing portion 70 placed in position 90 as shown in solid lines in FIG. 5, the throat of a fillet weld can be measured. To do so, a user places the angled surfaces 78 into contact with the two materials that are welded together. In one example, the two welded materials are positioned to form a right angle. The user then urges the measuring portion 64 into contact with the fillet weld located at the vertex of the two materials. The measurement of the throat of the fillet weld is then read at the location where the indicating mark 68 meets the graduated measurements 58 on the appropriate portion of the central column 56. In this way, the fillet gauge tool 54 measures the throat of a fillet weld to ensure its structural integrity, as the minimum throat corresponds to the lesser thickness of the two materials welded together.

In another example of weld dimension measurement, the fillet gauge tool 54 can be used to determine the leg length of the fillet weld. The wing portion 70 is rotated to the position 94 represented by dashed lines in FIG. 5. A corner of the wing portion 70 can be placed at the toe of the fillet weld where it meets one of the welded materials. The measuring portion 64 is then moved into a position where it contacts the other of the welded materials. The measurement of the leg length is then read at the location where the indicating mark 68 meets the graduated measurements 58 on the appropriate portion of the central column 56. Other weld measurements such as concavity and convexity of welds can be measured with the wing portion 70 located in position 94. It is also to be appreciated that the rotatable connection between the wing portion 70 and the central column 56 can enable the fillet gauge tool 54 to measure asymmetrical welds. Asymmetrical welds can be created as a welder applies a weld bead to one of two materials to be welded together, and then creates multiple weld beads (or passes) to fill in the volume between the first weld bead and the other welded material.

FIG. 5 also shows a third wing portion 70 location in position 96, shown in dashed lines. This position 96 can be used when the fillet gauge tool 54 is in the home position so that the wing portion 70 and the remainder of the fillet gauge tool 54 are substantially covered by the sleeve 14.

Figure 6:
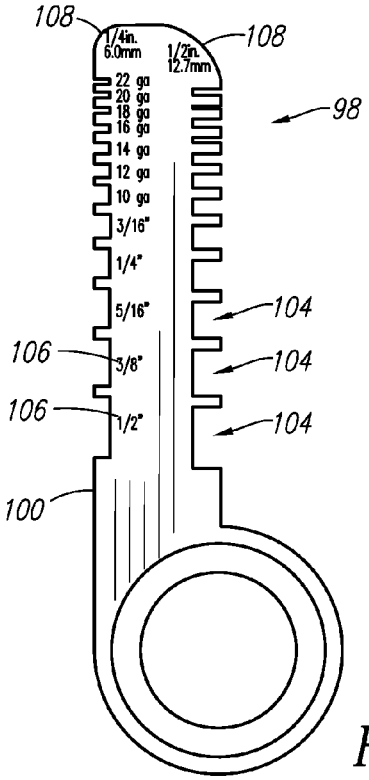
FIG. 6 is a front view of an example thickness gauge tool which can be included in the welder multi-tool of FIG. 1.

Turning to FIG. 6, the welder multi-tool also includes a thickness gauge tool 98. The thickness gauge tool 98 includes a main portion 100. The main portion 100 defines a plurality of notches 104 located on at least one edge of the main portion 100. Each of the notches 104 are formed to correspond with standardized nominal thicknesses of materials, e.g., sheet and plate metals. Each of the notches 104 includes a label 106 indicating the nominal width of the notch 104 as measured along the edge of the main portion 100. As some welding requirements are based upon the thickness of the materials to be welded, the thickness gauge tool 98 enables the user to quickly and accurately measure the thickness of the materials in order to determine proper weld requirements. In order to determine the thickness of the material, the user can remove the thickness gauge tool 98 from its home position and slide the material whose thickness is to be measured into at least one of the notches 104 until a snug fit is found. The user can then read the nominal thickness of the material from the label 106 corresponding to the snug-fitting notch 104. Notch 104 dimensions can be replicated on opposing edges of the thickness gauge tool 98 for the user's convenience, and one label can correspond with two notches 104.

In one example, the thickness gauge tool 98 also includes at least one rounded corner 108 defined by the edge of the main portion 100. The rounded corner 108 can be formed to a typical weld radius, such as ¼-inch or ½-inch. The thickness gauge tool 98 is labeled with the length of the radius, as shown in FIG. 6. The rounded corners 108 enable the user to place the thickness gauge tool 98 in contact with a concave fillet weld and relatively quickly determine the radius of the concave fillet weld.

Turning to FIG. 7, eight additional tools are shown which can also be rotatably attached to the axle 36. The welder multi-tool 10 can further include a soap stone 110. The soap stone 110 can be used to mark any number of welded materials, make notes on work pieces, etc. In one example, the soap stone 110 can be fastened into the tool at the base 114 with the use of a clip 116 or other similar structure that can limit the size of an opening in the base 114, effectively pinching the soap stone 110. Individual soap stones can be removed and inserted as required by use and/or wear.

The welder multi-tool 10 can also include a welding nozzle cleaner 120. During some types of welding processes, for example metal inert gas (MIG) welding, the MIG welder nozzle can become contaminated with weld spatter. The weld spatter can interfere with the flow of weld wire and the inert gas passed through the nozzle. As such, it is sometimes beneficial to remove the weld spatter with a welding nozzle cleaner. The welding nozzle cleaner 120 enables the user to have a ready cleaning tool that can be inserted into a welding nozzle in order to abrade and/or scrape away the weld spatter that is located within the welding nozzle.

The welder multi-tool 10 can further include a scraper 124. The scraper includes a chisel-like end 126 that can be used to remove weld spatter and other undesired contaminants from the surfaces of welded materials and/or the weld. The scraper 124 can also include a file 128. The file can be used for several functions, for example, to abrade undesired weld spatter from a weld, modify the weld dimension, shape a welded material, etc. In another example, the scraper 124 and the file 128 can be separated so that they are included on individual tools.

The welder multi-tool 10 can also include other tools. In one example, the welder multi-tool 10 includes a magnifying glass 130. The magnifying glass can enable the user to inspect fine details of the weld and the weld material. The magnifying glass 130 can be constructed of any number of suitable materials including plastics, glass, etc. The welder multi-tool 10 can also include a tape measure 134. The tape measure 134 can include a wound tape 136 including a hook 138 at an exposed end 140. The tape measure 134 can be extended, for example up to about two feet, by pulling on the exposed end 140 of the tape 136. The tape 136 can also be sprung so that it is automatically refracted into the base 144 after use.

Of course, other tools can also be included in the welder multi-tool 10. For example, a knife 146. Any number of knife configurations can be used. In one example, the knife includes a smooth portion 148 and a serrated portion 150. The welder multi-tool 10 can also include a bottle opener 154. In one example the bottle opener 154 can also include a flat head drive 156 to operate slotted screws, pry open containers, etc. The welder multi-tool 10 can also include a Phillips head drive 158 to operate Phillips head screws.

As previously described, the disclosed welder multi-tool 10 includes an offset between the central axis 30 of the sleeve 14 and the axis 46 of the axle 36, such that the two do not intersect. This offset can enable more effective use of the welder multi-tool 10. When one tool is removed from its home position for use and the remaining tools stay in their home position, the tools and the sleeve 14 act as a handle for the tool being used. Most of the mass of the welder multi-tool 10 remains in sleeve for the user to grip and provide leverage for operating the one tool being used. Additionally, the configuration of the sleeve 14 and the rounded button 40 enable a better ergonomic fit to the hand. The dimensions of the sleeve 14 provide a substantial volume for the user's clenched first to grip, providing leverage for tool use. In one particular example, the total length of the welder multi-tool 10 as measured along the central axis 30 of the sleeve 14 can be about 3-inches to 4-inches long. The total width of the welder multi-tool 10 as measured along the axis 46 of the axle 36 can be about 1½-inches wide. Furthermore, the rounded button 40 provides a ready place on one side of the sleeve 14 for the user's thumb and on the opposite side of the sleeve 14 for the user's index finger to nest and/or gain leverage while using individual tools.

The welder multi-tool 10 also includes an offset between the tool axes 48 and the axis 46 of the axle 36. This offset provides a greater moment arm between the sleeve 14 and the remaining tools and the tool being used. The greater moment arm enables the user to more easily apply a desired torque on the tool being used, particularly the tools that require rotation during use.

Each of the tools included in the welder multi-tool 10 can be formed of suitable materials. However, it is to be appreciated that several of the tools can be formed relatively inexpensively with an initial stamping operation to a selected metal alloy and then finished with particular machining or finishing operations to place the tool in final form for inclusion in the welder multi-tool 10.

In a further example, the welder multi-tool 10 can include a magnet 164 as shown in FIG. 3. The magnet 164 can be attached to the sleeve 14 or the axle 36. Wherever mounted, the magnet 164 enables the welder multi-tool 10 to be placed on a ferrous-containing surface for ease of storage and accessibility. The magnet 164 can also be used to attach the welder multi-tool 10 to a work piece which is being welded, so that the welder multi-tool 10 is located out of the way, yet can remain within convenient reach of the user. In another example, various components of the welder multi-tool can be constructed of materials that are permanently magnetized, so that the above described benefits can be present without the need of an additional magnet component, such as magnet 164.

Several benefits are realized by the described welder multi-tool. The welder multi-tool provides a number of tools consolidated into one relatively compact tool for use by those associated with welding activities. The welder multi-tool can be conveniently stored and transported while maintaining organization of the individual tools. When the tools are in the home position, the sleeve serves to protect the tools from harm by impact, abrasion, jostling, etc. that may normally be associated with groups of tools collected in a bag, toolbox, or pocket. The sleeve also serves to protect the user such that the tools are less likely to poke, gouge, scratch, or otherwise negatively affect the user, particularly as the user reaches or gropes for desired tools in a pocket, tool box, etc. The offset sleeve and tool orientation from the axis enables the user to have a ready handle that provides additional leverage compared to other hand tools.

The disclosure has been described with reference to the example embodiments described above. Modifications and alterations will occur to others upon a reading and understanding of this specification. Example embodiments incorporating one or more aspects are intended to include all such modifications and alterations insofar as they come within the scope of the appended claims.

What is claimed is:

1. A welder multi-tool comprising:

a sleeve, wherein the sleeve comprises a first leg portion and a second leg portion, and a bridge portion interconnecting the first leg portion and the second leg portion at respective first ends of the leg portions, the sleeve extending along a central axis passing through the bridge portion and wherein the sleeve at least partially defines a space between the leg portions;

a single axle attached to the sleeve and spanning, along an axis, the space defined between the leg portions, wherein the axis of the axle does not intersect the central axis of the sleeve; and a plurality of tools rotatably attached to the axle and movable to a home position between the leg portions, each of the plurality of tools having a tool axis, wherein each tool axis is substantially parallel with the central axis of the sleeve when the plurality of tools is in the home position between the leg portions, wherein each tool axis does not intersect the axis of the axle, wherein the plurality of tools includes a fillet gauge tool comprising:

a central column including at least one set of graduated measurements;

a measuring portion, wherein the measuring portion is slidingly engaged with the central column, wherein the measuring portion defines a slot;

a wing portion, wherein the wing portion is rotatably attached to the central column along the tool axis of the fillet gauge tool, wherein the wing portion includes two angled surfaces such that the two angled surfaces form an angle having a vertex that intersects with the tool axis of the fillet gauge tool; and a locking portion attached to the central column such that the locking portion extends through the slot in the measuring portion, wherein the plurality of tools further includes a thickness gauge tool comprising:

a main portion defining a plurality of notches located on an edge of the main portion, wherein each of the notches includes a label indicating the nominal width of the notch as measured along the edge of the main portion, wherein the thickness gauge tool further includes a first rounded corner and a second rounded corner defined by edges of the main portion, wherein a radius length of the first rounded corner is different from a radius length of the second rounded corner, and the radius length of the first rounded corner and the radius length of the second rounded corner are labeled on the thickness gauge tool.

2. The welder multi-tool according to claim 1, wherein the sleeve is bent to form the bridge portion interconnecting the first leg portion and the second leg portion.

3. The welder multi-tool according to claim 1, wherein the plurality of tools is configured to be placed in the home position located in the space between the leg portions such that the sleeve substantially covers the plurality of tools.

4. The welder multi-tool according to claim 1, wherein the plurality of tools can rotate 360° about the axle.

5. The welder multi-tool according to claim 1, further including a magnet attached to one of the sleeve and the axle.

6. The welder multi-tool according to claim 1, wherein the plurality of tools further includes a soap stone, a scraper, a file, a welding nozzle cleaner, a magnifying glass, a tape measure, a knife, a bottle opener, a flat head drive, and a Phillips head drive.

7. The welder multi-tool according to claim 1, wherein each of the tools can be individually rotated about the axle.

8. A welder multi-tool comprising:

a sleeve, wherein the sleeve comprises a first leg portion and a second leg portion, and a bridge portion interconnecting the first leg portion and the second leg portion at respective first ends of the leg portions, the sleeve extending along a central axis passing through the bridge portion and wherein the sleeve at least partially defines a space between the leg portions;

a single axle attached to the sleeve and spanning, along an axis, the space defined between the leg portions, wherein the axis of the axle does not intersect the central axis of the sleeve; and a plurality of tools rotatably attached to the axle and movable to a home position between the leg portions, each of the plurality of tools having a tool axis, wherein each tool axis is substantially parallel with the central axis of the sleeve when the plurality of tools is in the home position between the leg portions, wherein each tool axis does not intersect the axis of the axle, wherein the plurality of tools includes a fillet gauge tool, a thickness gauge tool, a soap stone, and a welding nozzle cleaner.

9. The welder multi-tool according to claim 8, wherein the fillet gauge tool comprises:

a central column;

a measuring portion, wherein the measuring portion is slidingly engaged with the central column;

a wing portion, wherein the wing portion is rotatably attached to the central column along the tool axis of the fillet gauge tool; and a locking portion attached to the central column.

10. The welder multi-tool according to claim 8, wherein the thickness gauge tool comprises a main portion defining a plurality of notches located on an edge of the main portion, wherein the thickness gauge tool further includes a first rounded corner and a second rounded corner defined by edges of the main portion, wherein a radius length of the first rounded corner is different from a radius length of the second rounded corner, and the radius length of the first rounded corner and the radius length of the second rounded corner are labeled on the thickness gauge tool.

11. The welder multi-tool according to claim 8, wherein the sleeve is bent to form the bridge portion interconnecting the first leg portion and the second leg portion.

12. The welder multi-tool according to claim 8, wherein the plurality of tools is configured to be placed in the home position located in the space between the leg portions such that the sleeve substantially covers the tools.

13. The welder multi-tool according to claim 8, wherein the tools can rotate 360° about the axle.

14. The welder multi-tool according to claim 8, further including a magnet attached to one of the sleeve and the axle.

15. The welder multi-tool according to claim 8, further including at least one tool selected from the group consisting of a scraper, a file, a magnifying glass, a tape measure, a knife, a bottle opener, a flat head drive, and a Phillips head drive.

16. The welder multi-tool according to claim 8, wherein each of the tools can be individually rotated about the axle.

* * * * *